US010248082B2

(12) United States Patent
Hiraya

(10) Patent No.: US 10,248,082 B2
(45) Date of Patent: Apr. 2, 2019

(54) TIMEPIECE MOVEMENT, MECHANICAL TIMEPIECE, AND METHOD FOR RELEASING PAWL LEVER FROM ENGAGEMENT

(71) Applicant: Seiko Epson Corporation, Tokyo (JP)

(72) Inventor: Eiichi Hiraya, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/837,204

(22) Filed: Dec. 11, 2017

(65) Prior Publication Data

US 2018/0164744 A1 Jun. 14, 2018

(30) Foreign Application Priority Data

Dec. 13, 2016 (JP) ..... 2016-241136

(51) Int. Cl.
*G04B 11/04* (2006.01)
*G04B 5/00* (2006.01)

(52) U.S. Cl.
CPC ..... *G04B 11/04* (2013.01); *G04B 5/00* (2013.01)

(58) Field of Classification Search
CPC . G04B 11/04; G04B 5/00; G04B 5/14; G04B 19/02
USPC ..... 368/207, 148–149, 208, 150–151, 28
See application file for complete search history.

(56) References Cited

U.S. PATENT DOCUMENTS 4,091,302 A * 5/1978 Yamashita ..... H02N 2/18 310/339
6,485,172 B1 11/2002 Takahashi et al.
7,300,200 B2 * 11/2007 Suzuki ..... G04B 9/005 368/212
2006/0193208 A1 * 8/2006 Suzuki ..... G04B 19/02 368/28

FOREIGN PATENT DOCUMENTS

JP 11-183645 A 7/1999

* cited by examiner

*Primary Examiner* — Edwin A. Leon
(74) *Attorney, Agent, or Firm* — Harness, Dickey & Pierce, P.L.C.

(57) ABSTRACT

A timepiece movement includes: a barrel wheel; a ratchet wheel; a rotary weight; a transmission wheel that causes the ratchet wheel to rotate; a pawl lever that engages with the transmission wheel, is interlocked with the rotary weight, and performs forward/backward movement in directions of approaching and moving away from the transmission wheel; a base panel; and a wheel train bearing provided between the base panel and the rotary weight. The pawl lever and the transmission wheel are positioned between the base panel and the wheel train bearing. The transmission wheel is pivotally supported by the wheel train bearing. The wheel train bearing is provided with a release portion for releasing the pawl lever and the transmission wheel from engagement therebetween by moving the pawl lever.

15 Claims, 11 Drawing Sheets

TIMEPIECE MOVEMENT, MECHANICAL TIMEPIECE, AND METHOD FOR RELEASING PAWL LEVER FROM ENGAGEMENT

BACKGROUND

1. Technical Field

The present invention relates to a timepiece movement, a mechanical timepiece, and a method for releasing a pawl lever from engagement.

2. Related Art

In the related art, as an automatic winding mechanism of a mainspring in a mechanical timepiece, there is a mechanism that includes a rotary weight, an eccentric wheel that is interlocked with the rotary weight to pivot around, a pawl lever that is attached to the eccentric wheel and has a pushing pawl and a pulling pawl, and a transmission wheel that engages with the pushing pawl and the pulling pawl of the pawl lever and causes a ratchet wheel to rotate. According to the mechanism, the eccentric wheel is interlocked with the rotary weight and rotates, and thereby the pawl lever performs forward/backward movement in directions of approaching and moving away from the transmission wheel. The transmission wheel rotates in one direction in an interlocking manner with the forward/backward movement of the pawl lever, the ratchet wheel is interlocked with the transmission wheel and rotates, and a mainspring is wound (for example, see JP-A-11-183645).

An automatic winding timepiece disclosed in JP-A-11-183645 is provided with a third bearing or a transmission bearing on a back cover side of a first transmission wheel (eccentric wheel), a pawl lever, and a second transmission wheel (transmission wheel), and the first transmission wheel is pivotally supported by the third bearing, and the second transmission wheel is pivotally supported by the transmission bearing.

Incidentally, in a mechanical timepiece, there is a case where a mainspring is unwound to a predetermined state during an operation check of a wheel train that drives pointers. In order to unwind the mainspring, a ratchet wheel needs to rotate in an opposite direction to a winding direction. However, in the automatic winding timepiece in JP-A-11-183645, the pawl lever engages with the second transmission wheel (transmission wheel) that meshes with the ratchet wheel, and the second transmission wheel rotates only in the winding direction. Hence, it is not possible to cause the ratchet wheel to rotate in the opposite direction to the winding direction.

Therefore, the third bearing, the transmission bearing, or the like are detached, the automatic winding mechanism is disassembled, and a clasp and the ratchet wheel are released from engagement therebetween. Then, the pawl lever and the second transmission wheel are released from the engagement therebetween, and turning of a ratchet screw or the like is performed with a driver. In this manner, the ratchet wheel is rotated in the opposite direction to the winding direction. In this case, a problem arises in that the work is complicated.

SUMMARY

An advantage of some aspects of the invention is to provide a timepiece movement, a mechanical timepiece, and a method for releasing engagement of a pawl lever in which it is possible to easily release a pawl lever and a transmission wheel from engagement therebetween.

A timepiece movement according to an aspect of the invention includes: a barrel wheel; a ratchet wheel; a rotary weight; a transmission wheel that causes the ratchet wheel to rotate; a pawl lever that engages with the transmission wheel, is interlocked with the rotary weight, and performs forward/backward movement in directions of approaching and moving away from the transmission wheel; a base panel; and a wheel train bearing provided between the base panel and the rotary weight. The pawl lever and the transmission wheel are positioned between the base panel and the wheel train bearing. The transmission wheel is pivotally supported by the wheel train bearing. The wheel train bearing is provided with a release portion for releasing the pawl lever and the transmission wheel from engagement therebetween by moving the pawl lever.

In this configuration, the release portion is used, and thereby it is possible to release the pawl lever and the transmission wheel from the engagement therebetween without detaching the wheel train bearing. Therefore, the work is simplified, compared to a case where the wheel train bearing is detached, the automatic winding mechanism is disassembled, and then releasing is performed from the engagement.

In the timepiece movement according to the aspect of the invention, it is preferable that the release portion is a through-hole which penetrates through the wheel train bearing and into which an operation member that moves the pawl lever is inserted.

In this configuration, the operation member such as a pin from the rotary weight side is inserted into the through-hole, and the operation member is pushed in the direction in which the pawl lever moves away from the transmission wheel. In this manner, it is possible to release the pawl lever and the transmission wheel from engagement thereof. Accordingly, since it is possible to provide the release portion only by forming the through-hole in the wheel train bearing, it is possible to easily manufacture the timepiece movement.

In the timepiece movement according to the aspect of the invention, it is preferable that the pawl lever has a pulling pawl lever portion and a pushing pawl lever portion which pinch the transmission wheel therebetween in plan view, and the pulling pawl lever portion has a pulling pawl that engages with the transmission wheel. It is preferable that the pushing pawl lever portion has a pushing pawl that engages with the transmission wheel, and the release portion is a first through-hole and a second through-hole that penetrate through the wheel train bearing. It is preferable that, in a case where the pawl lever is positioned at a predetermined position in a movable range of the forward/backward movement, a part of an opening of the first through-hole on the base panel side overlap the pulling pawl lever portion and the rest of the opening is positioned on the pushing pawl lever portion side from the pulling pawl lever portion in plan view, and a part of an opening of the second through-hole on the base panel side overlap the pushing pawl lever portion and the rest of the opening is positioned on the pulling pawl lever portion side from the pushing pawl lever portion in plan view.

In this configuration, in a case where the pawl lever is positioned at the predetermined position, the openings of the first through-hole and the second through-hole on the base panel side are divided into one region in which the opening overlaps the pawl lever and one region in which the openings do not overlap the pawl lever, when viewed from the rotary weight side.

The operation member is inserted into one region that does not overlap the pawl lever and the pawl lever is moved by the operation member in a direction from the region to the pawl lever. In this manner, it is possible to release the pawl lever and the transmission wheel from the engagement therebetween.

Therefore, according to the aspect of the invention, it is possible for an operator to easily find an insertion position of the operation member or a movement direction of the pawl lever.

In the timepiece movement according to the aspect of the invention, it is preferable that the predetermined position is a position at which the pawl lever is closest to the transmission wheel.

An area of the portion of the pawl lever, which overlaps the openings of the first through-hole and the second through-hole on the base panel side in plan view, is set within a range in which the pawl lever is bent so as to retreat in a direction orthogonal to the insertion direction of the operation member even when the operation member comes into contact with the portion.

In general, as the pawl lever is close to the transmission wheel, the distance between the pulling pawl lever portion and the pushing pawl lever portion is wider. Therefore, in a case where the pawl lever is positioned at a position other than the predetermined position, an area of the pulling pawl lever portion, which overlaps the first through-hole and an area of the pushing pawl lever portion which overlaps the second through-hole are not large in plan view, compared to a case where the pawl lever is positioned at a predetermined position.

Therefore, in a case where the pawl lever is positioned at a position other than the predetermined position, it is possible to reduce an occurrence of a case where the pawl lever is pressed and deformed against the operation member even when the operation member is inserted into the first through-hole and the second through-hole. In other words, even when the operation member does not come into contact with the pawl lever or the operation member comes into contact with the pawl lever, the pawl lever is bent and moves to retreat.

In the timepiece movement according to the aspect of the invention, it is preferable that an opening of the first through-hole on the rotary weight side is larger than the opening of the first through-hole on the base panel side, and an opening of the second through-hole on the rotary weight side is larger than the opening of the second through-hole on the base panel side.

In this configuration, since the openings of the first through-hole and the second through-hole on the rotary weight side are larger than the operation member in diameter, the operation member is likely to be inserted into the first through-hole and the second through-hole.

In the timepiece movement according to the aspect of the invention, it is preferable that the rotary weight is provided in the wheel train bearing.

In this configuration, the rotary weight is caused to pivot around such that the through-hole is exposed as necessary, and the operation member is inserted into the through-hole. In this manner, it is possible to release the pawl lever and the transmission wheel from the engagement therebetween without disassembling of the timepiece movement.

It is preferable that the timepiece movement according to the aspect of the invention further includes: a winding stem; and a manual winding wheel train that is interlocked with rotation of the winding stem and causes the ratchet wheel to rotate.

In this configuration, in a state in which the pawl lever and the transmission wheel are released from the engagement therebetween by the release portion, the winding stem is caused to rotate in the opposite direction to the winding direction, and thereby it is possible to unwind the mainspring. In this manner, in order to unwind the mainspring, there is no need to turn the ratchet screw with the driver.

A mechanical timepiece according to an aspect of the invention includes: the timepiece movement described above; and a case in which the timepiece movement is accommodated.

In this configuration, a back cover of the mechanical timepiece is opened and it is possible to release the pawl lever and the transmission wheel from the engagement therebetween by the release portion. In this manner, there is no need to take out the timepiece movement from the case, and thus it is possible to simplify the work.

A method for releasing a pawl lever from engagement in a timepiece movement according to an aspect of the invention includes: a barrel wheel; a ratchet wheel; a rotary weight; a transmission wheel that causes the ratchet wheel to rotate; a pawl lever that engages with the transmission wheel, is interlocked with the rotary weight, and performs forward/backward movement in directions of approaching and moving away from the transmission wheel; a base panel; and a wheel train bearing provided between the base panel and the rotary weight, in which the pawl lever and the transmission wheel are positioned between the base panel and the wheel train bearing, the transmission wheel is pivotally supported by the wheel train bearing, and the wheel train bearing is provided with a through-hole, the method including: inserting an operation member into the through-hole from the rotary weight side, pushing and moving the pawl lever by the operation member, and releasing the pawl lever and the transmission wheel from engagement therebetween.

In this configuration, the work is simplified, compared to a case where the wheel train bearing is detached, the automatic winding mechanism is disassembled, and then releasing is performed from the engagement.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment according to the invention will be described with reference to figures.

Configuration of Timepiece

Figure 1:
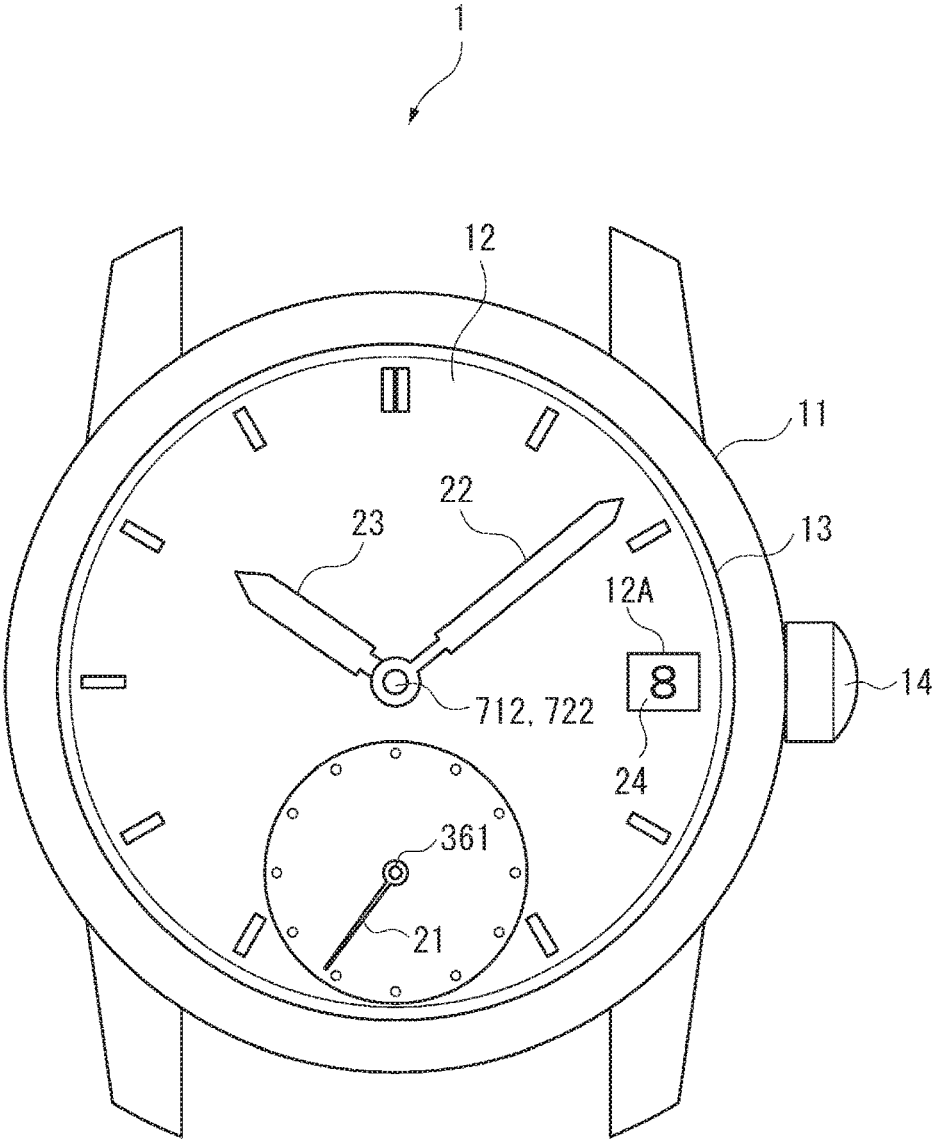
FIG. 1 is a plan view illustrating a timepiece in an embodiment according to the invention.

FIG. 1 is a plan view illustrating a timepiece 1 which is a mechanical timepiece.

The timepiece 1 includes a cylindrical exterior case 11, and a disc-shaped character panel 12 is disposed on an inner circumferential side of the exterior case 11. One opening on a timepiece face side of two openings of the exterior case 11 is closed with a cover glass 13, and the other opening on the back surface side is closed with aback cover (not illustrated). Here, the exterior case 11 and the back cover configure a case.

The timepiece 1 includes a movement 2 (refer to FIG. 2) accommodated in the case, a small second hand 21, a minute hand 22, and an hour hand 23, and a date wheel 24.

The pointers 21 to 23 are disposed on a surface side of the character panel 12, and the movement 2 is disposed on a back surface side of the character panel 12. The pointers 21 to 23 are attached to rotary shafts 361, 712, and 722 provided in the movement 2 and are driven by the movement 2. The minute hand 22 and the hour hand 23 are attached to the rotary shafts 712 and 722 provided at the plane center of the character panel 12, and the small second hand 21 is attached to the rotary shaft 361 provided on the six o'clock direction side with respect to the plane center of the character panel 12.

In addition, a small calendar window 12A is provided on the character panel 12, and a number of the date wheel 24 is visible from the small calendar window 12A. The number of the date wheel 24 indicates a "date" of the year, month, and date.

A crown 14 is provided on a side surface of the exterior case 11. An operation of the crown 14 enables an input to be performed in response to the operation.

Configuration of Movement

Figure 2:
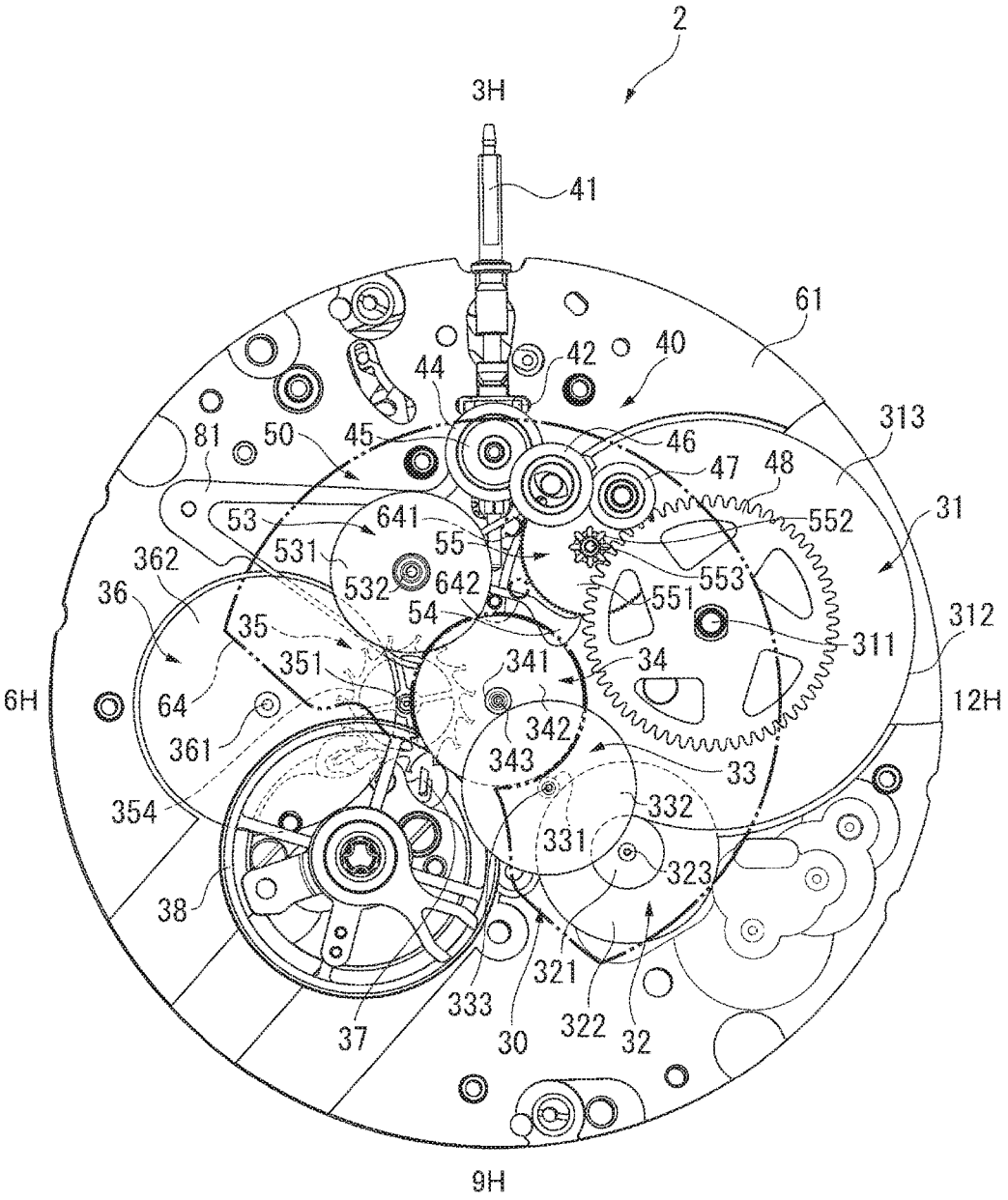
FIG. 2 is a plan view illustrating a movement in the embodiment.

FIG. 2 is a plan view obtained when the movement 2 of the timepiece 1 (a timepiece movement) is viewed from the back cover side. In FIG. 2, the upper side of the figure represents a three o'clock direction side, the lower side of the figure represents a nine o'clock direction side, the right side of the figure represents a twelve o'clock direction side and the left side of the figure represents a six o'clock direction side. In FIG. 2, only wheel train bearing 64 of bearing members is illustrated in a two-dot chain line, and the rest of members are omitted in the figure. In addition, in FIG. 2, a rotary weight 51, a bearing 52, and the like are also omitted.

The movement 2 includes abase wheel train 30, a small second wheel 36, a pallet 37, a balance wheel 38, a manual winding mechanism 40, and an automatic winding mechanism 50.

FIGS. 3 to 6 are sectional views of main parts of the movement 2. In FIGS. 3 to 6, the upper side of the figure is the back cover side and the lower side of the figure is the side of the character panel 12.

The movement 2 includes a base panel 61, a winding stem bearing 62, a winding bearing 63, and the wheel train bearing 64 from the character panel 12 to the back cover side. The wheel train bearing 64 is also referred to as a rotary weight bearing.

Base Wheel Train

Figure 3:
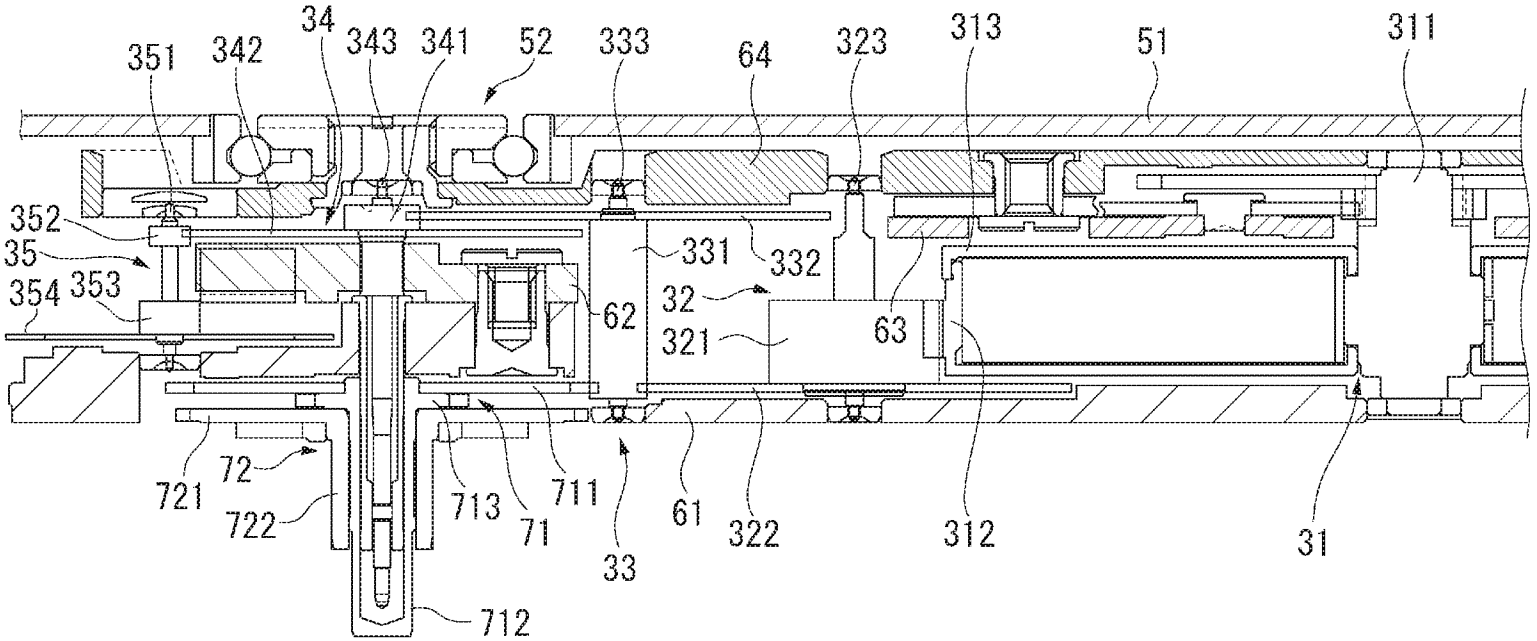
FIG. 3 is a sectional view of main parts (base wheel train) of the movement in the embodiment.
Figure 4:
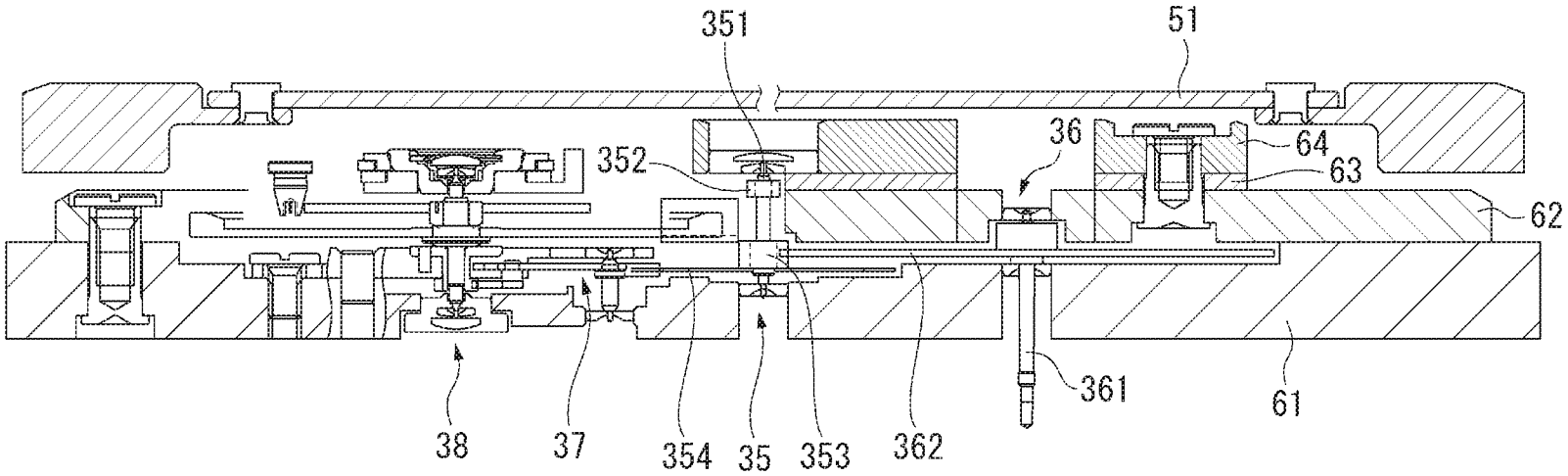
FIG. 4 is a sectional view of main parts (a pallet, a balance wheel, and a small second wheel) of the movement in the embodiment.

As illustrated in FIGS. 2 to 4, the base wheel train 30 includes a barrel wheel 31, a second wheel 32, a third wheel 33, a fourth wheel 34, and an escape wheel 35.

Barrel Wheel

As illustrated in FIGS. 2 and 3, the barrel wheel 31 includes a barrel stem 311, a barrel gear 312, a barrel cover 313, and a mainspring (not illustrated) accommodated in a space surrounded by the barrel gear 312 and the barrel cover 313.

The barrel stem 311 is provided on the one o'clock direction side with respect to the plane center of the character panel 12 in plan view and is pivotally supported by the base panel 61 and the wheel train bearing 64.

The mainspring is wound when the barrel stem 311 is caused to rotate by the manual winding mechanism 40 or the automatic winding mechanism 50 which will be described below. The barrel gear 312 rotates around the barrel stem 311 when the wound mainspring is rewound.

Second Wheel

The second wheel 32 includes a rotary shaft 323, a second pinion 321, and a second gear 322. The rotary shaft 323 and the second pinion 321 are integrally formed. The rotary shaft 323 is provided on the ten o'clock direction side with respect to the plane center of the character panel 12 in plan view and is pivotally supported by the base panel 61 and the wheel train bearing 64. The second pinion 321 meshes with the barrel gear 312, and the second wheel 32 rotates in an interlocked manner with the barrel gear 312.

The timepiece 1 separately includes a minute wheel 71 to which the pointer 22 (minute hand) is attached, and thus the rotary shaft 323 of the second wheel 32 can be provided at a position shifted from the plane center of the character panel 12.

Third Wheel

The third wheel 33 includes a rotary shaft 333, a third pinion 331, and a third gear 332. The rotary shaft 333 and the third pinion 331 are integrally formed. The rotary shaft 333 is provided on the ten o'clock direction side with respect to the plane center of the character panel 12 in plan view and is provided to be closer to the plane center side of the character panel 12 than the rotary shaft 323 of the second wheel 32. In addition, the rotary shaft 333 is pivotally supported by the base panel 61 and the wheel train bearing 64. The third pinion 331 meshes with the second gear 322, and the third wheel 33 rotates in an interlocked manner with the second wheel 32.

Fourth Wheel

The fourth wheel 34 includes a rotary shaft 343, a fourth pinion 341, and a fourth gear 342. The rotary shaft 343 and the fourth pinion 341 are integrally formed. The rotary shaft 343 is provided at the plane center of the character panel 12 in plan view and is pivotally supported by the base panel 61 and the wheel train bearing 64. The fourth pinion 341 meshes with the third gear 332, and the fourth wheel 34 rotates in an interlocked manner with the third wheel 33.

Here, on the side of the character panel 12 of the base panel 61, the minute wheel 71 and a cylindrical wheel 72 (refer to FIG. 3), which are provided with rotary shafts (pointer shafts) 712 and 722, and a back date wheel (not illustrated) are provided at the plane center of the character panel 12 in plan view.

The minute wheel 71 includes a rotary shaft 712, a minute gear 711, and a minute pinion 713 that is integrally formed with the rotary shaft 712. The minute gear 711 meshes with the third pinion 331, and the minute wheel 71 rotates in an interlocked manner with the third wheel 33. A gear of the back date wheel meshes with the minute pinion 713, and the back date wheel rotates in an interlocked manner with the minute wheel 71. The cylindrical wheel 72 includes a rotary shaft 722 and a cylindrical gear 721 that is integrally formed with the rotary shaft 722. The cylindrical gear 721 meshes with a pinion of the back date wheel, and the cylindrical wheel 72 rotates in an interlocked manner with the back date wheel.

The minute hand 22 is attached to the rotary shaft 712 of the minute wheel 71, and the hour hand 23 is attached to the rotary shaft 722 of the cylindrical wheel 72.

Escape Wheel

The escape wheel 35 includes a rotary shaft 351, a first escape pinion 352 (refer to FIG. 3), a second escape pinion 353 (refer to FIG. 3), and an escape gear 354. The rotary shaft 351 and the first escape pinion 352 are integrally formed. The rotary shaft 351 is provided on the six o'clock direction side with respect to the plane center of the character panel 12 in plan view and is pivotally supported by the base panel 61 and the wheel train bearing 64. The first escape pinion 352 meshes with the fourth gear 342, and the escape wheel 35 rotates in an interlocked manner with the fourth wheel 34.

Pallet and Balance Wheel

As illustrated in FIGS. 2 and 4, the pallet 37 includes two pawl stones, which mesh with the escape gear 354, sends the escape gear 354, and controls a rotating speed of the escape wheel 35 depending on rotation reciprocating movement of the balance wheel 38. In this manner, the rotating speeds of the barrel wheel 31, the second wheel 32, the third wheel 33, the fourth wheel 34, and the small second wheel 36 are controlled.

The timepiece 1 includes a regulating lever 81 (refer to FIG. 2), and when adjusting time, the regulating lever 81 abuts on a tenon of the balance wheel 38 and the movement of the balance wheel 38 is regulated. The regulating lever 81 engages with a clutch wheel 43 attached to the winding stem 41, which will be described below, and the regulating lever rotates in an interlocked manner with the movement of the clutch wheel 43 in a winding-stem shaft direction. The regulating lever 81 is pulled by two steps from a state in which the winding stem 41 is pushed in the central direction of the movement 2 (zero step position), and the regulating lever abuts on the tenon when it is possible to adjust time.

Small Second Wheel

As illustrated in FIGS. 2 and 4, the small second wheel 36 includes a rotary shaft (pointer shaft) 361, to which the small second hand 21 is attached, and a small second gear 362.

The rotary shaft 361 is provided on the six o'clock direction side with respect to the plane center of the character panel 12 in plan view to be on a side opposite to the plane center side of the character panel 12 with respect to the rotary shaft 351 of the escape wheel 35. In addition, a portion of the rotary shaft 361 on the back cover side is pivotally supported by the winding stem bearing 62, a portion of the rotary shaft 361 on the character panel 12 side is pivotally supported by the base panel 61, and the front end of the rotary shaft projects from the base panel 61 toward the character panel 12.

The small second gear 362 meshes with the second escape pinion 353, and the small second wheel 36 rotates in an interlocked manner with the escape wheel 35. Here, the small second wheel 36 rotates at the same speed as the fourth wheel 34.

Manual Winding Mechanism

Figure 5:
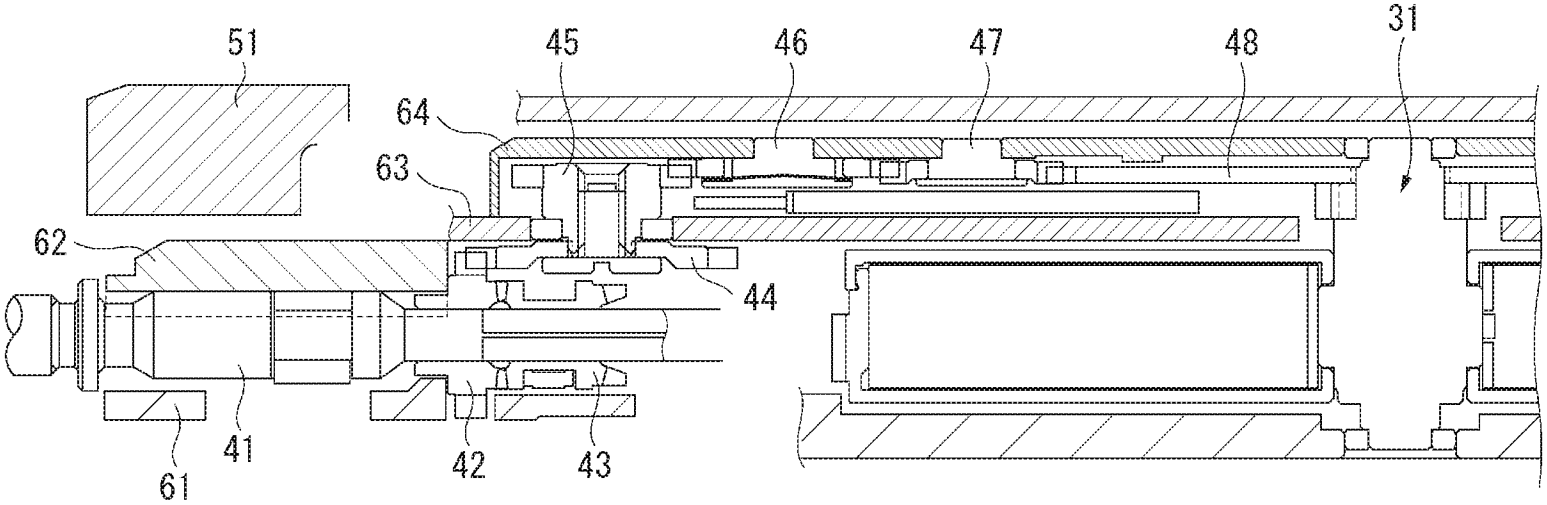
FIG. 5 is a sectional view of main parts (manual winding mechanism) of the movement in the embodiment.

As illustrated in FIGS. 2 and 5, the manual winding mechanism 40 includes the winding stem 41, a base wheel 42, the clutch wheel 43, a crown wheel 44, ratchet transmission wheels 45, 46, and 47, and a ratchet wheel 48. Here, the base wheel 42, the clutch wheel 43, the crown wheel 44, the ratchet transmission wheels 45 to 47 configure a manual winding wheel train that causes the ratchet wheel 48 to rotate in an interlocked manner with the rotation of the winding stem 41.

The winding stem 41 is provided between the base panel 61 and the winding stem bearing 62 and the winding bearing 63. The base wheel 42, the clutch wheel 43, and the crown wheel 44 are provided between the base panel 61 and the winding bearing 63.

The clutch wheel 43 is provided with a quadrangular hole that penetrates through the rotation center, and the winding stem 41 is inserted into the hole. In this manner, the clutch wheel 43 integrally rotates with the winding stem 41.

The base wheel 42 is provided with a circular hole that penetrates through the rotation center, and the winding stem 41 is rotatably inserted into the hole. In a case where the winding stem 41 is positioned at a zero step, the base wheel 42 meshes with the clutch wheel 43 and rotates in an interlocked manner with the clutch wheel 43.

The crown wheel 44 meshes with the base wheel 42 and rotates in an interlocked manner with the base wheel 42.

The ratchet transmission wheels 45 to 47 and the ratchet wheel 48 are provided between the winding bearing 63 and the wheel train bearing 64. A portion of the ratchet transmission wheel 45 on the character panel 12 side is pivotally supported by the winding bearing 63. Portions of the ratchet transmission wheels 46 and 47 on the back cover side are pivotally supported by the wheel train bearing 64.

The ratchet transmission wheels 45, 46, and 47 rotate in an interlocked manner with the crown wheel 44 and cause the ratchet wheel 48 to rotate. When the ratchet wheel 48 rotates, the barrel stem 311 integrally rotates with the ratchet wheel 48, and the mainspring is wound.

In the manual winding mechanism 40, a user rotates the crown 14 attached to the front end of the winding stem 41, thereby making it possible for the mainspring to be wound.

Automatic Winding Mechanism

Figure 6:
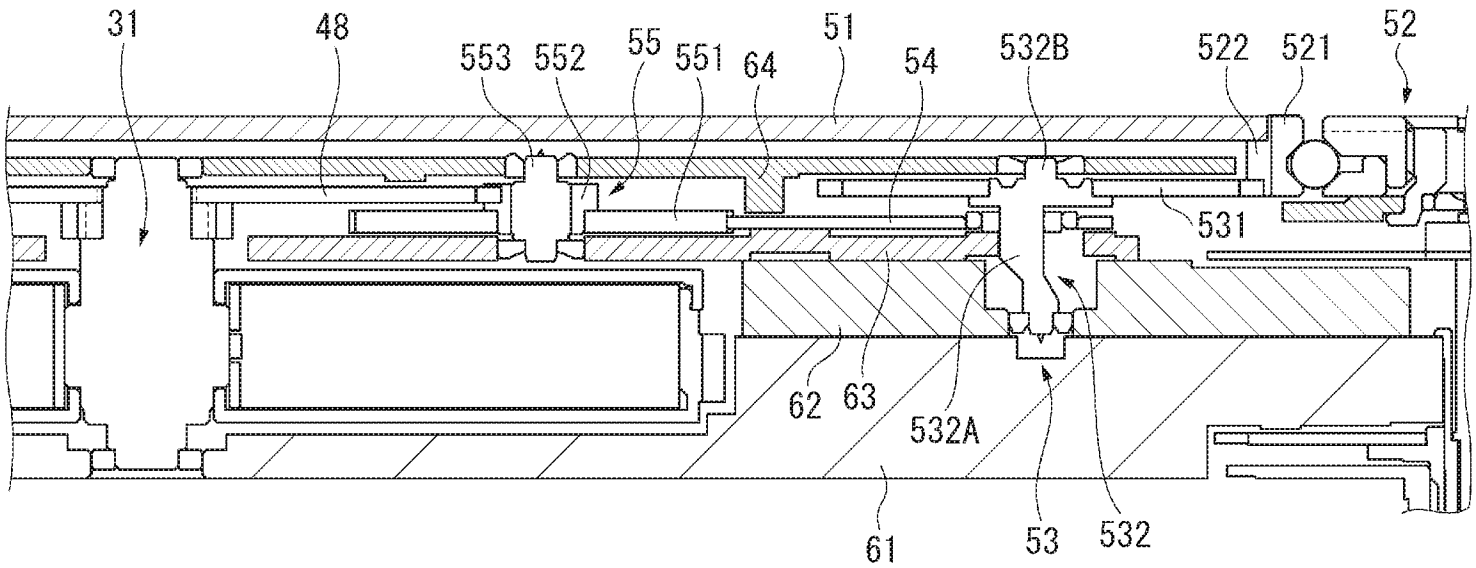
FIG. 6 is a sectional view of main parts (automatic winding mechanism) of the movement in the embodiment.
Figure 7:
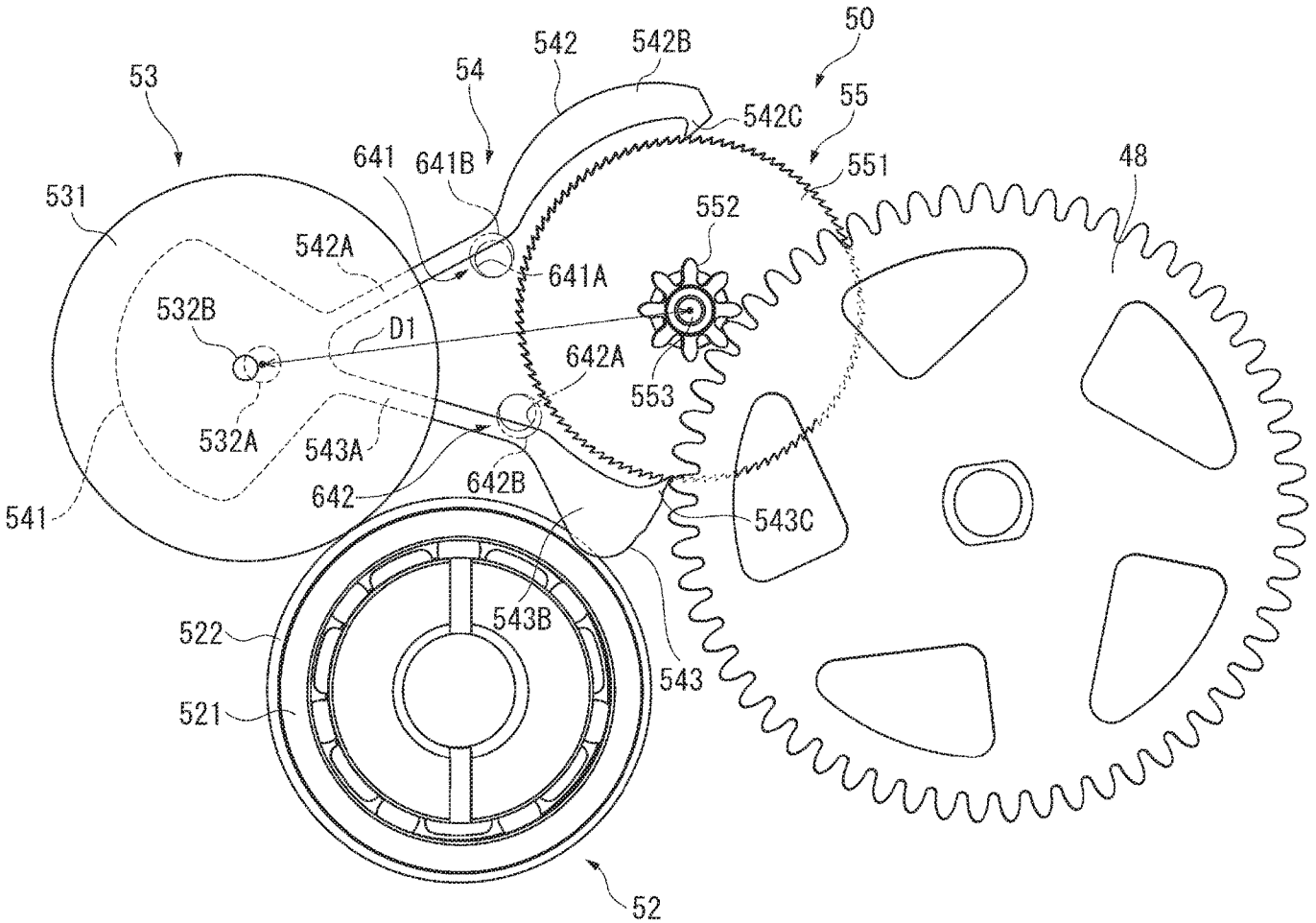
FIG. 7 is a plan view of main parts (automatic winding wheel train) of the movement in the embodiment.

FIG. 7 is a plan view of main parts of the movement 2. As illustrated in FIGS. 2, 6, and 7, the automatic winding mechanism 50 includes a rotary weight 51 (refer to FIG. 6), the bearing 52 (refer to FIGS. 6 and 7), an eccentric wheel 53, a pawl lever 54, and a transmission wheel 55. Here, the eccentric wheel 53, the pawl lever 54, the transmission wheel 55 configure an automatic winding wheel train that causes the ratchet wheel 48 to rotate in an interlocked manner with the rotary weight 51.

The bearing 52 has a rotary shaft at the plane center of the character panel 12 in plan view. The bearing 52 is provided on the back cover side of the wheel train bearing 64 and is pivotally supported by the wheel train bearing 64.

Figure 8:
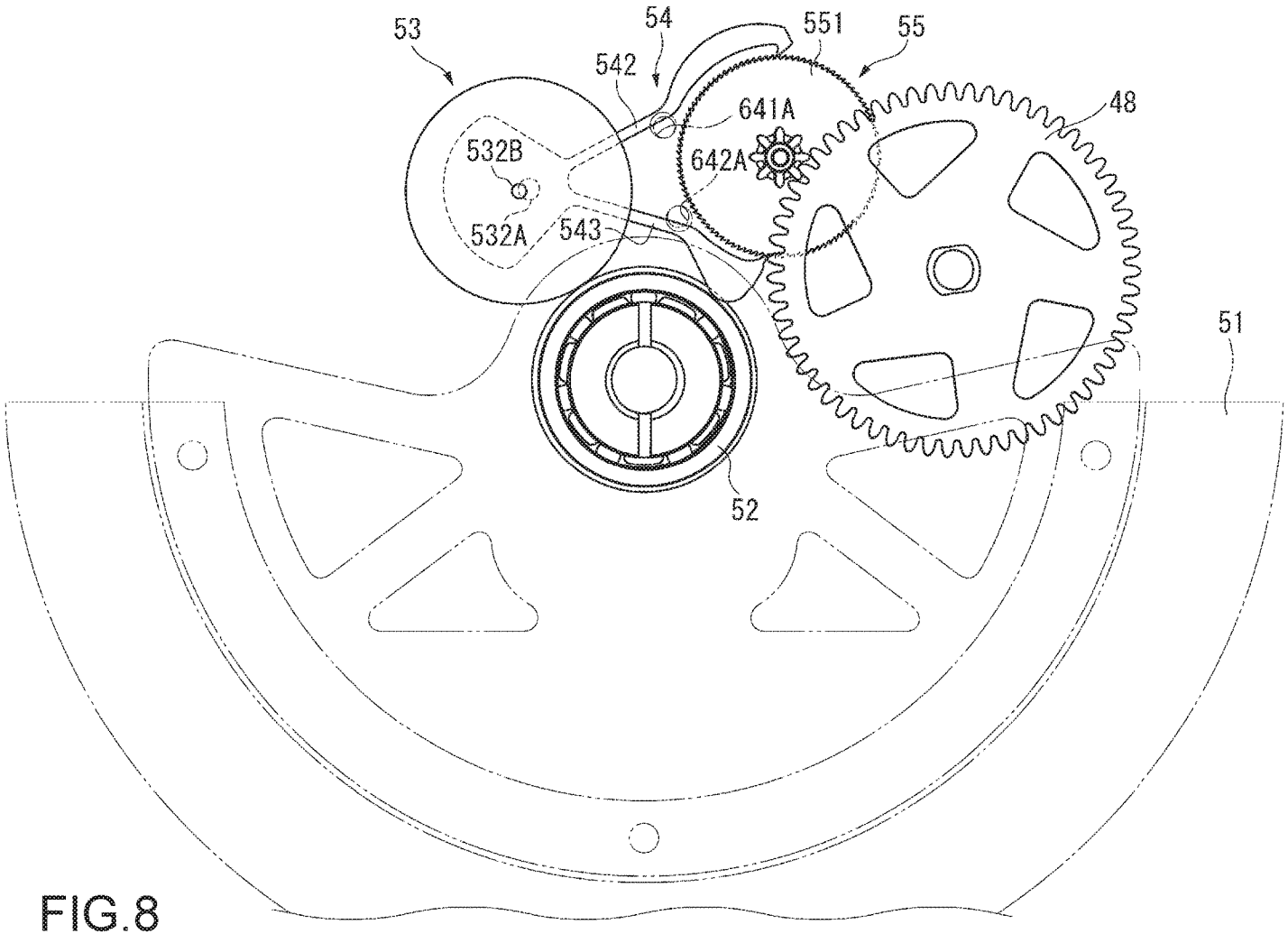
FIG. 8 is a view illustrating a positional relationship between a through-hole and a pawl lever that performs forward/backward movement in the embodiment.

The rotary weight 51 has a semicircular shape around the rotary shaft of the bearing 52 in plan view (refer to FIG. 8). The rotary weight 51 is provided on the back cover side of the wheel train bearing 64 and is attached to an outer wheel 521 of the bearing 52. In this manner, the outer wheel 521 integrally rotates with the rotary weight 51.

The eccentric wheel 53 includes an eccentric shaft member 532 and an eccentric gear 531 attached to the eccentric shaft member 532. The eccentric shaft member 532 is provided on the four o'clock direction side with respect to the plane center of the character panel 12 in plan view. The eccentric shaft member 532 is inserted into a hole provided in the winding bearing 63, a portion of the eccentric shaft member on the character panel 12 side is pivotally supported by the winding stem bearing 62, and a portion thereof on the back cover side is pivotally supported by the wheel train bearing 64.

In addition, the eccentric shaft member 532 includes an eccentric shaft 532A that is eccentric from a rotary shaft 532B. The pawl lever 54, which will be described below, is rotatably attached to the eccentric shaft 532A.

The eccentric gear 531 is provided between the winding bearing 63 and the wheel train bearing 64 in an axial direction. The eccentric gear 531 meshes with a rotary weight pinion 522 provided on an outer circumference of the outer wheel 521 of the bearing 52, and the eccentric wheel 53 rotates in an interlocked manner with the rotary weight 51. In this manner, the eccentric shaft 532A revolves around the rotary shaft 532B of the eccentric wheel 53, and the pawl lever 54 attached to the eccentric shaft 532A performs the forward/backward movement in a direction of approaching the transmission wheel 55 and in a direction of moving away from the transmission wheel. A stroke of the forward/backward movement of the pawl lever 54 has a length twice a distance between the center of the rotary shaft 532B and the center of the eccentric shaft 532A.

The pawl lever 54 is provided between the winding bearing 63 and the wheel train bearing 64 and is rotatably attached to the eccentric shaft 532A. In addition, a portion of the pawl lever 54 on the character panel 12 side is supported by the winding bearing 63.

As illustrated in FIG. 7, the pawl lever 54 includes a base end portion 541 provided with a hole, into which the eccentric shaft 532A is inserted, and a pulling pawl lever portion 542 and a pushing pawl lever portion 543 that extend from the base end portion 541 and pinch a transmission gear 551 of the transmission wheel 55 in plan view. Here, in plan view, an interval between the pulling pawl lever portion 542 and the pushing pawl lever portion 543 is widened as the portions move away from the base end portion 541.

The pulling pawl lever portion 542 includes an extension portion 542A extending from the base end portion 541 on a straight line, a bending portion 542B that is continuous to the extension portion 542A and is bent along the outer circumference of the transmission gear 551 in plan view, and a pulling pawl 542C that projects from the front end of the bending portion 542B toward the transmission gear 551 and engages with the transmission gear 551.

The pushing pawl lever portion 543 includes an extension portion 543A extending from the base end portion 541 on a straight line, a bending portion 543B that is continuous to the extension portion 543A and is bent along the outer circumference of the transmission gear 551 in plan view, and a pushing pawl 543C that projects from the front end of the bending portion 543B toward the transmission gear 551 and engages with the transmission gear 551.

An example of a material of the pawl lever 54 can include carbon tool steels (for example, SK-5 or SK-4).

As illustrated in FIGS. 2, 6, and 7, the transmission wheel 55 includes a rotary shaft 553, a transmission gear 551, and the transmission pinion 552. The rotary shaft 553 and the transmission pinion 552 are integrally formed.

The rotary shaft 553 is provided on the two o'clock direction side with respect to the plane center of the character panel 12 in plan view and is pivotally supported by the winding bearing 63 and the wheel train bearing 64.

The pulling pawl 542C and the pushing pawl 543C of the pawl lever 54 engage with the transmission gear 551, and the transmission wheel 55 rotates in one direction in an interlocked manner with the forward/backward movement of the pawl lever 54. The ratchet wheel 48 rotates in an interlocked manner with the transmission wheel 55. When the ratchet wheel 48 rotates, the barrel stem 311 integrally rotates with the ratchet wheel 48, and the mainspring is wound.

In the automatic winding mechanism 50, a user waves by arm in a state in which the timepiece 1 is worn on the arm and causes the rotary weight 51 to pivot around, and thereby it is possible to wind the mainspring.

Configuration of Through-Hole of Wheel Train Bearing

As illustrated in FIG. 2, the wheel train bearing 64 overlaps an automatic winding wheel train in plan view and is provided with two through-hole 641 (first through-hole) and through-hole 642 (second through-hole) having a circular shape in plan view at a position corresponding to the pawl lever 54 as illustrated in FIGS. 2 and 7. The through-holes 641 and 642 will be described below in detail. Operation pins are inserted into the through-holes so as to release the pawl lever 54 and the transmission wheel 55 from the engagement therebetween. In other words, the through-holes 641 and 642 correspond to a release portion for performing releasing from the engagement.

FIG. 7 illustrates a state in which the pawl lever 54 is disposed at a position (approaching position) closest to the transmission wheel 55 in a movable range of the forward/backward movement. In other words, a state in which a distance D1 between the eccentric shaft 532A of the eccentric wheel 53 and the rotary shaft 553 of the transmission wheel 55 becomes shortest is illustrated. In this state, the operation pins are inserted into the through-holes 641 and 642.

When the pawl lever 54 is positioned at the approaching position, as illustrated in FIG. 7, a part of an opening 641A of the through-hole 641 on the character panel 12 side overlaps an end portion of the extension portion 542A on the bending portion 542B side, and the rest of the opening is positioned on the pushing pawl lever portion 543 side from the end portion in plan view. In addition, the center of the opening 641A is positioned on the pushing pawl lever portion 543 side from the end portion in plan view.

Here, an area of the portion of the extension portion 542A, which overlaps the opening 641A, is set within a range in which the pulling pawl lever portion 542 is bent so as to retreat in a direction orthogonal to the insertion direction of the operation pin even when the operation pin comes into contact with the portion.

On the other hand, a part of an opening 642A of the through-hole 642 on the character panel 12 side overlaps an end portion of the extension portion 543A on the bending portion 543B side, and the rest of the opening is positioned on the pulling pawl lever portion 542 side from the end portion. In addition, the center of the opening 642A is positioned on the pulling pawl lever portion 542 side from the end portion in plan view.

Here, an area of the portion of the extension portion 543A, which overlaps the opening 642A, is set within a range in which the pushing pawl lever portion 543 is bent so as to retreat in a direction orthogonal to the insertion direction of the operation pin even when the operation pin comes into contact with the portion.

The openings 641A and 642A have the diameter that is substantially equal to the diameter of the operation pin. In addition, the diameter of the opening 641B of the through-hole 641 on the back cover side is larger than the diameter of the opening 641A, and the diameter of the opening 642B of the through-hole 642 on the back cover side is larger than the diameter of the opening 642A.

Positional Relationship Between Through-Hole and Pawl Lever Performing Forward/Backward Movement In the embodiment, as illustrated in FIG. 8, in a case where the rotary weight 51 is positioned on the nine o'clock direction side, the eccentric shaft 532A is closest to the rotary shaft 553 of the transmission wheel 55. At this time, as illustrated in FIG. 7, a part of the opening 641A overlaps the pulling pawl lever portion 542, and a part of the opening 642A overlaps the pushing pawl lever portion 543, in plan view.

Figure 9:
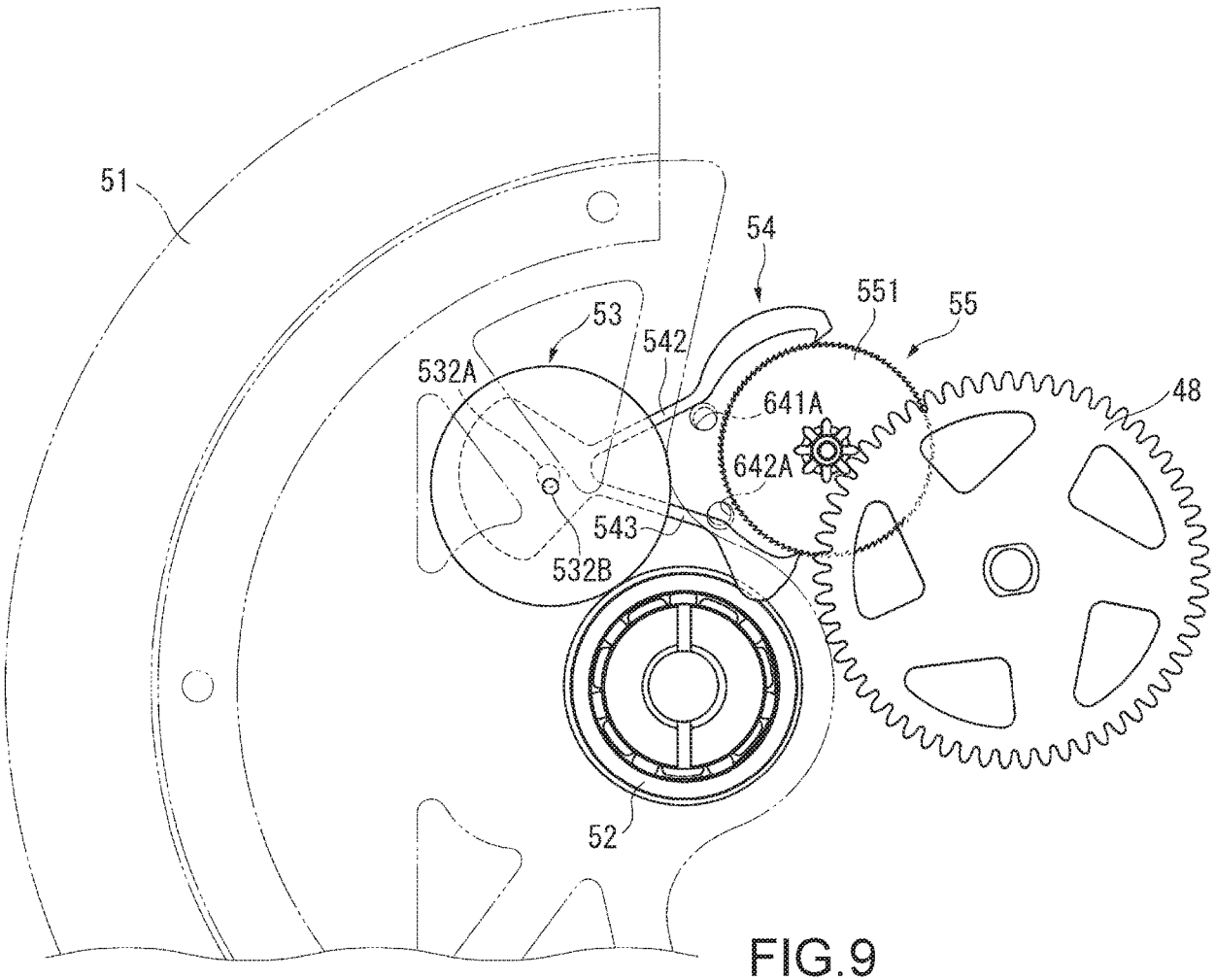
FIG. 9 is a view illustrating a positional relationship between the through-hole and the pawl lever that performs forward/backward movement in the embodiment.

Next, as illustrated in FIG. 9, when the rotary weight 51 rotates clockwise by 90 degrees when viewed from the back cover side and moves to the six o'clock direction side, the eccentric shaft 532A rotates counterclockwise around the rotary shaft 532B of the eccentric wheel 53 by 90 degrees. In this manner, the pawl lever 54 moves away from the transmission wheel 55. At this time, the opening 641A does not overlap the pulling pawl lever portion 542, and a part of the opening 642A overlaps the pushing pawl lever portion 543, in plan view.

Figure 10:
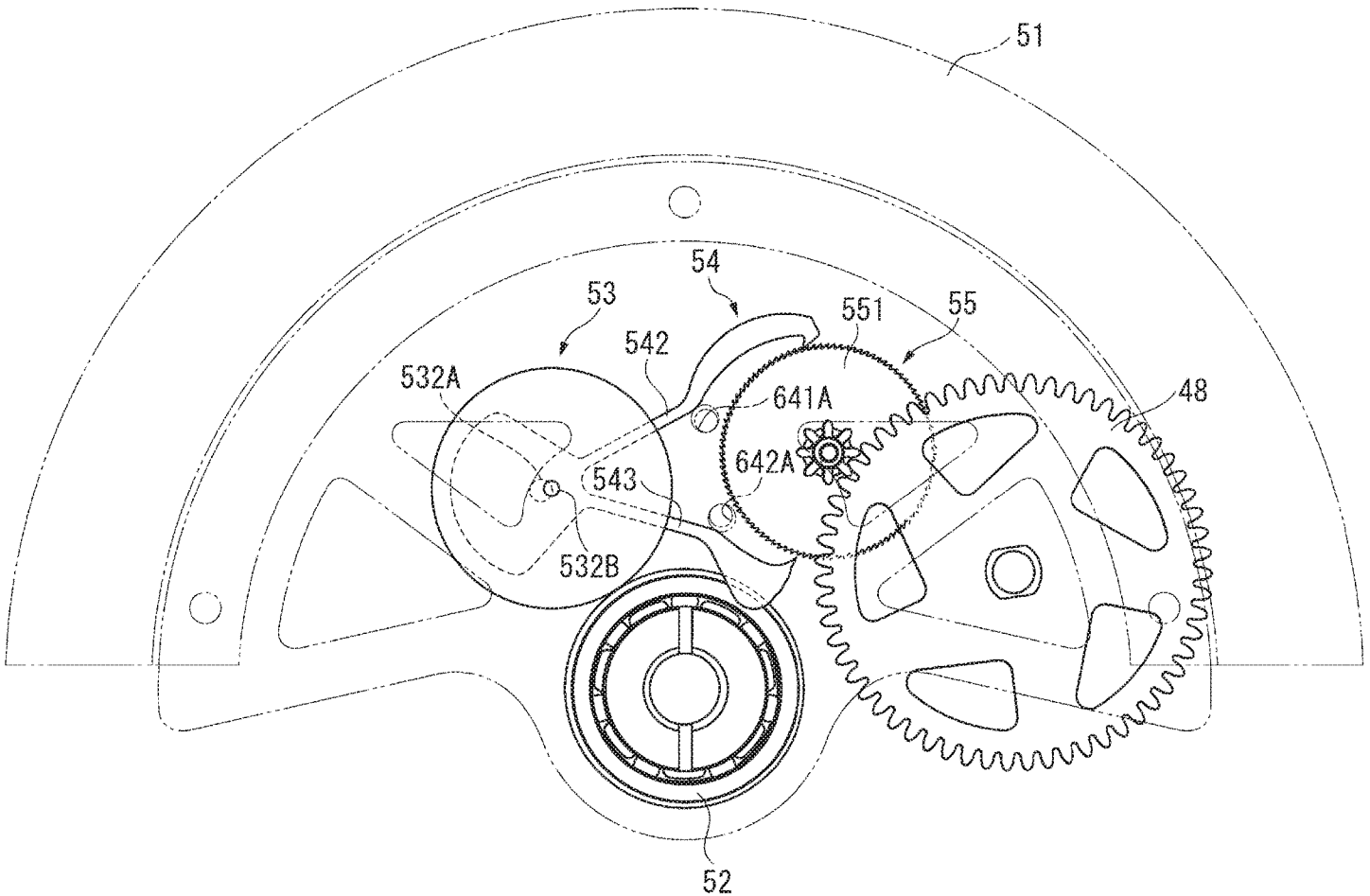
FIG. 10 is a view illustrating a positional relationship between the through-hole and the pawl lever that performs forward/backward movement in the embodiment.

Next, as illustrated in FIG. 10, when the rotary weight 51 further rotates clockwise by 90 degrees and moves to the three o'clock direction side, the eccentric shaft 532A further rotates counterclockwise around the rotary shaft 532B of the eccentric wheel 53 by 90 degrees. In this case, the eccentric shaft 532A moves farthest away from the rotary shaft 553 of the transmission wheel 55. At this time, the opening 641A does not overlap the pulling pawl lever portion 542, and the opening 642A does not overlap the pushing pawl lever portion 543, in plan view.

Figure 11:
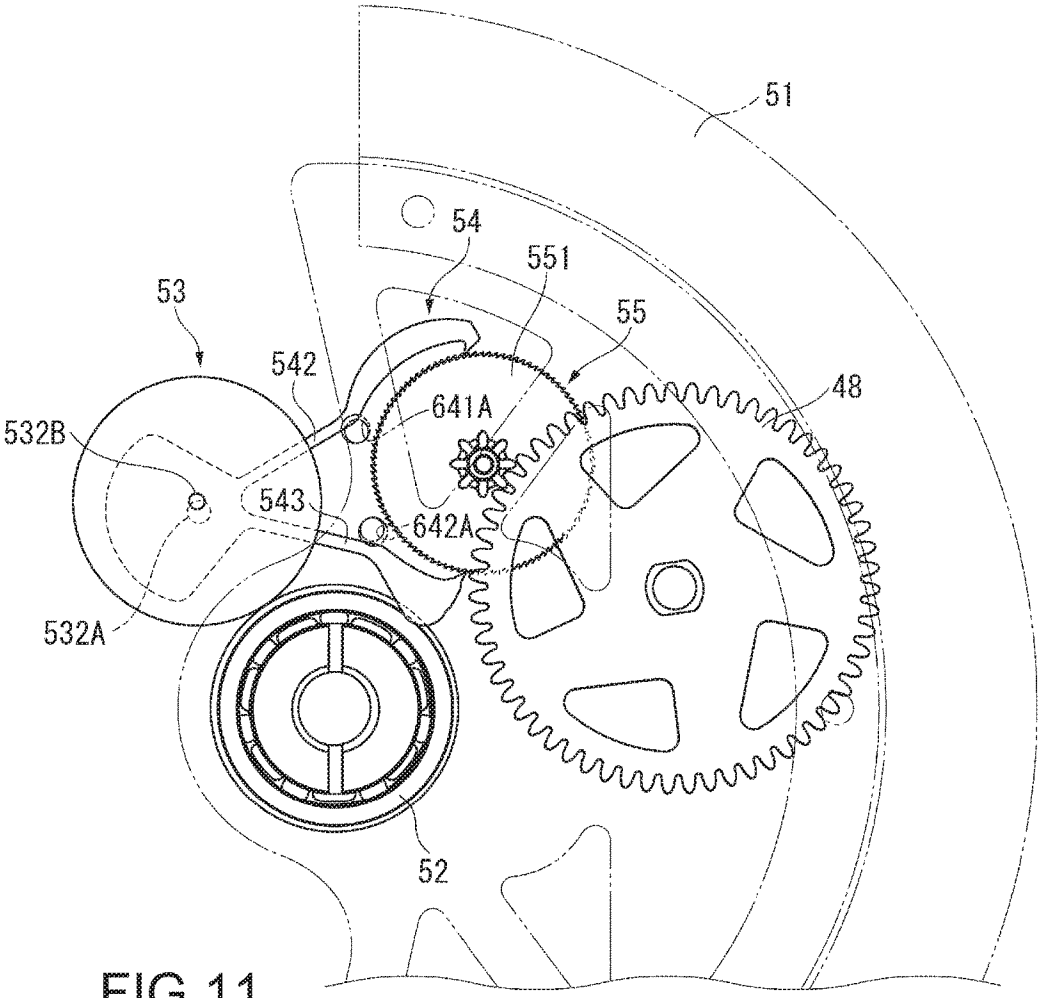
FIG. 11 is a view illustrating a positional relationship between the through-hole and the pawl lever that performs forward/backward movement in the embodiment.

Next, as illustrated in FIG. 11, when the rotary weight 51 further rotates clockwise by 90 degrees and moves to the twelve o'clock direction side, the eccentric shaft 532A further rotates counterclockwise around the rotary shaft 532B of the eccentric wheel 53 by 90 degrees. In this manner, the pawl lever 54 approaches the transmission wheel 55. At this time, apart of the opening 641A overlaps the pulling pawl lever portion 542, and the opening 642A does not overlap the pushing pawl lever portion 543, in plan view.

When the rotary weight 51 further rotates clockwise by 90 degrees and moves to the nine o'clock direction side, the state returns to that in FIG. 8.

In other words, the interval between the pulling pawl lever portion 542 and the pushing pawl lever portion 543 is widened as the lever portions approach the transmission wheel 55. Therefore, in a case where the pawl lever 54 is positioned at a position other than the approaching position (a case of a state illustrated in FIGS. 9 to 11), an area of the pulling pawl lever portion 542, which overlaps the opening 641A, and an area of the pushing pawl lever portion 543, which overlaps the opening 642A, are not large in plan view, compared to a case where the pawl lever 54 is positioned at the approaching position.

Therefore, in a case where the pawl lever 54 is positioned at a position other than the approaching position, it is possible to reduce an occurrence of a case where the pawl lever 54 is pressed and deformed against the operation pin even when the operation pin is inserted into the through-holes 641 and 642. In other words, even when the operation pin does not come into contact with the pawl lever 54 or the operation pin comes into contact with the pawl lever, the pawl lever 54 is bent and moves to retreat.

Method for Releasing Pawl Lever from Engagement

In order to release the pawl lever 54 and the transmission wheel 55 from the engagement therebetween in the movement 2, first, the rotary weight 51 is moved to the nine o'clock direction side, as illustrated in FIGS. 7 and 8, the through-holes 641 and 642 are exposed on the back cover side, and the pawl lever 54 is disposed at a position closest to the transmission wheel 55.

Next, the operation pins (operation member) having a round front end are inserted into the through-holes 641 and 642 from the back cover side, respectively. When the operation pin is inserted into the through-hole 641, the front end of the operation pin comes into contact with the extension portion 542A. When the operation pin is further inserted, the extension portion 542A slides over the front end of the operation pin and is bent and moves to a side opposite to the pushing pawl lever portion 543 side with respect to the operation pin in plan view. In other words, the extension portion moves in a direction of being separated from the transmission gear 551. In this manner, the pulling pawl 542C and the transmission gear 551 are released from the engagement therebetween.

When the operation pin is inserted into the through-hole 642, the front end of the operation pin comes into contact with the extension portion 543A. When the operation pin is further inserted, the extension portion 543A slides over the front end of the operation pin and is bent and moves to a side opposite to the pulling pawl lever portion 542 side with respect to the operation pin in plan view. In other words, the extension portion moves in a direction of being separated from the transmission gear 551. In this manner, the pushing pawl 543C and the transmission gear 551 are released from the engagement therebetween.

In this manner, it is possible to release the pawl lever 54 and the transmission gear 551 from the engagement therebetween.

Method for Unwinding Mainspring

When the mainspring is unwound in the movement 2, first, the crown 14 is fixed by finger and the rotation of the ratchet wheel 48 is regulated.

In a state in which the rotation of the ratchet wheel 48 is regulated, the pawl lever 54 and the transmission wheel 55 are released from the engagement therebetween by the above described method for releasing the pawl lever from the engagement.

In a state in which the releasing is performed from the engagement, the crown 14 is rotated in a direction opposite to the winding direction. In this manner, the ratchet wheel 48 rotates in the direction opposite to the winding direction and the mainspring is unwound to a predetermined position.

Instead of an operation of the crown 14, the ratchet screw is fixed or turned with a driver. In this manner, the rotation of the ratchet wheel 48 may be regulated or the ratchet wheel may be rotated.

Operational Effect of Embodiment

In the timepiece 1, it is possible to release the pawl lever 54 and the transmission wheel 55 from the engagement therebetween without detaching the wheel train bearing 64. Therefore, the work is simplified, compared to a case where the wheel train bearing 64 is detached, the automatic winding mechanism 50 is disassembled, and then releasing is performed from the engagement. In addition, it is possible to perform the releasing from the engagement without detaching the movement 2 from the case.

In addition, through only an operation of inserting the operation pins into the through-holes 641 and 642, it is possible to release the pawl lever 54 and the transmission wheel 55 from the engagement therebetween. Therefore, it is possible to more simplify the work.

In addition, since the openings 641B and 642B of the through-holes 641 and 642 on the back cover side have the diameter larger than the diameter of the operation pin, it is possible to easily insert the operation pins into the through-holes 641 and 642.

When the mainspring is unwound to the predetermined position, there is no need to detach the wheel train bearing 64, and thus there is no need to provide a component such as a clasp for regulating the rotation of the ratchet wheel 48. In other words, in a case of detaching the wheel train bearing 64, the automatic winding mechanism 50 is disassembled, and the rotation of the ratchet wheel 48 is not regulated by the automatic winding mechanism 50. Therefore, the ratchet wheel 48 rotates in the direction opposite to the winding direction and the mainspring is likely to be completely unwound. In order to regulate this state, it is necessary to provide a component such as a clasp for stopping the ratchet wheel 48 from rotating in a direction opposite to the winding direction. In the timepiece 1, when the mainspring is unwound to the predetermined position, there is no need to detach the wheel train bearing 64, and thus there is no need to provide the component described above. Therefore, it is possible to reduce the costs, and it is also possible to simplify an assembly process of the movement 2.

Since it is possible to provide the release portion only by forming the through-holes 641 and 642 in the wheel train bearing 64, it is possible to easily manufacture the movement 2.

Therefore, in a case where the pawl lever 54 is positioned at a position other than the approaching position, it is possible to reduce an occurrence of a case where the pawl lever 54 is pressed and deformed against the operation pin even when the operation pins are inserted into the through-holes 641 and 642.

In a state in which the pawl lever 54 and the transmission wheel 55 are released from the engagement therebetween by the operation pin, the winding stem 41 is caused to rotate in the direction opposite to the winding direction, and thereby it is possible to unwind the mainspring. Therefore, in order to unwind the mainspring, there is no need to turn the ratchet screw with the driver.

Since the rotary shaft 323 of the second wheel 32 and the rotary shaft 343 of the fourth wheel 34 do not overlap each other in plan view, the portions of the second wheel 32 and the fourth wheel 34 on the back cover side can be pivotally supported by the common wheel train bearing 64. In addition, since the rotary shaft 343 of the fourth wheel 34 and the rotary shaft 532B of the eccentric wheel 53 do not overlap each other in plan view, the portions of the fourth wheel 34 and the eccentric wheel 53 on the back cover side can be pivotally supported by the common wheel train bearing 64. In this manner, in the timepiece 1, the base wheel train and the automatic winding wheel train are pivotally supported by one bearing member (wheel train bearing 64) on the back cover side.

Therefore, the movement 2 is likely to be thin, compared to a case where the portions of the base wheel train and the automatic winding wheel train on the back cover side are pivotally supported by a plurality of bearing members which overlap in a thickness direction. In addition, since it is possible to reduce the number of components, it is possible to reduce the weight of the movement 2 or it is possible to reduce the costs of the movement 2.

In addition, compared to a case where the portion of the base wheel train on the back cover side is pivotally supported by the plurality of bearing members, it is possible to have little influence of manufacturing variations in bearing members, and it is possible to improve the accuracy of the timepiece.

Since the minute wheel 71, to which the minute hand (pointer 22) is attached, is provided on the character panel 12 side with respect to the base panel 61, it is possible to pivotally support the portion of the fourth wheel 34 on the back cover side by the wheel train bearing 64 even when the fourth wheel 34 and the minute wheel 71 are coaxially provided. In this manner, in the timepiece 1, the portions of the base wheel train and the automatic winding wheel train on the back cover side are pivotally supported by the common wheel train bearing 64, and thus it is possible to coaxially provide the pointer axis of the minute hand and the rotary shaft 343 of the fourth wheel 34.

Since the portions of the ratchet transmission wheels 46 and 47 on the back cover side, which configure the manual winding wheel train, are pivotally supported by the wheel train bearing 64, it is possible to reduce the number of bearing members, compared to a case where the wheels are pivotally supported by bearing members other than the wheel train bearing 64.

Other Embodiments

The invention is not limited to the embodiments described above, and the invention also includes modification, improvement, and the like in a range in which it is possible to achieve the object of the invention.

In the embodiment, the release portion, which releases the pawl lever 54 and the transmission wheel 55 from the engagement therebetween, is the through-holes 641 and 642 provided in the wheel train bearing 64; however, the invention is not limited thereto. For example, the release portion may be a switch lever that is controllable from the back cover side of the wheel train bearing 64, moves the pawl lever 54, and switches between engagement and engagement release of the pawl lever 54 and the transmission wheel 55.

In the embodiment, a part of the opening 641A overlaps the end portion of the extension portion 542A on the bending portion 542B side in plan view; however, the invention is not limited thereto. For example, the opening may overlap the other portion of the extension portion 542A. However, in a case where the opening overlaps the end portion, it is possible to move the pulling pawl lever portion 542 by the operation pin inserted into the through-hole 641 with a weak force, compared to a case where the opening overlaps the other portion. In addition, a part of the opening 641A may overlap the bending portion 542B.

In addition, in the embodiment, apart of the opening 642A overlaps the end portion of the extension portion 543A on the bending portion 543B side in plan view; however, the invention is not limited thereto. For example, the opening may overlap the other portion of the extension portion 543A. However, in a case where the opening overlaps the end portion, it is possible to move the pushing pawl lever portion 543 by the operation pin inserted into the through-hole 642 with a weak force, compared to a case where the opening overlaps the other portion. In addition, a part of the opening 642A may overlap the bending portion 543B.

In addition, in the embodiment, the diameter of the operation pin is substantially equal to the diameter of the openings 641A and 642A of the through-holes 641 and 642 on the character panel 12 side; however, the invention is not limited thereto. For example, the diameter of the operation pin may be smaller.

In this case, the operation pin is inserted into one region that does not overlap the pawl lever 54 and the pawl lever 54 is pushed by the operation pin in a direction from the region to the pawl lever 54, with respect to the openings 641A and 642A. In this manner, it is possible to release the pawl lever 54 and the transmission wheel 55 from the engagement therebetween.

In addition, the region of a part of the opening 641A may be positioned on the side opposite to the pushing pawl lever portion 543 side with respect to the pulling pawl lever portion 542 in plan view. Similarly, the region of a part of the opening 642A may be positioned on the side opposite to the pulling pawl lever portion 542 side with respect to the pushing pawl lever portion 543 in plan view. However, in this case, it is difficult to know which region in the openings 641A and 642A, into which the operation pin may be inserted, or which direction in which the pawl lever 54 may be moved. Therefore, it is preferable that the opening 641A is not positioned on the side opposite to the pushing pawl lever portion 543 side with respect to the pulling pawl lever portion 542, and the opening 642A is not positioned on the side opposite to the pulling pawl lever portion 542 side with respect to the pushing pawl lever portion 543.

In addition, the diameter of the openings 641B and 642B of the through-holes 641 and 642 on the back cover side may be equal to or smaller than the diameter of the openings 641A and 642A. In addition, the through-hole 641 and the through-hole 642 may be one common communicating through-hole.

In other words, the through-hole may have a configuration (shape, dimension, disposition) in which the pawl lever 54 is moved by the inserted operation pin and it is possible to release the pawl lever 54 and the transmission wheel 55 from the engagement therebetween.

In the embodiment, the automatic winding mechanism 50 includes the eccentric wheel 53; however, the mechanism may not include the eccentric wheel 53. For example, an eccentric shaft may be provided on the back cover side of the bearing 52, and the pawl lever may be attached to the eccentric shaft.

In the embodiment, the wheel train bearing 64 is configured of one bearing member; however, the invention is not limited thereto. In other words, the wheel train bearing 64 may be configured of a plurality of bearing members. For example, the bearing member that pivotally supports the transmission wheel 55 is separately provided from the bearing member provided with the through-holes 641 and 642. In addition, the through-hole 641 and the through-hole 642 may be provided in separate bearing members, respectively. However, in this case, when the bearing members are positioned with low accuracy, the positions of the through-holes 641 and 642 are likely to be shifted with respect to the pawl lever 54. Therefore, it is preferable that the through-holes 641 and 642 are provided in one bearing member that pivotally supports the eccentric wheel 53 and the rotary shaft 553 of the transmission wheel 55.

In the embodiment, the rotary weight 51 is pivotally supported by the wheel train bearing 64; however, the invention is not limited thereto. For example, the rotary weight 51 may be pivotally supported by another bearing member provided on the back cover side of the wheel train bearing 64. However, in a case where the rotary weight 51 is pivotally supported by the wheel train bearing 64, the rotary weight 51 is disposed such that the through-holes 641 and 642 do not overlap the rotary weight 51 in plan view, and thereby it is possible to expose the through-holes 641 and 642 on the back cover side. Therefore, it is possible to release the pawl lever 54 and the transmission wheel 55 from the engagement therebetween without detaching the movement 2.

The embodiment has a configuration in which, in a case where the pawl lever 54 is positioned to be closest to the transmission wheel 55, the operation pin is inserted into the through-holes 641 and 642, and thereby the pawl lever 54 and the transmission wheel 55 are released from the engagement therebetween; however, the invention is not limited thereto. In other words, a configuration in which, in a case where the pawl lever 54 is disposed at any position (at the predetermined position) in a movable range in the forward/backward movement, the releasing is performed from the engagement may be employed.

In the embodiment, the timepiece 1 includes the small second hand 21; however, the invention is not limited thereto. For example, instead of the small second hand 21, the timepiece may include a second hand attached to the rotary shaft 343 of the fourth wheel 34. In this case, the small second wheel 36 and the second escape pinion 353 of the escape wheel 35 may not be provided.

The entire disclosure of Japanese Patent Application No. 2016-241136, filed Dec. 13, 2016 is expressly incorporated by reference herein.

What is claimed is:

1. A timepiece movement comprising:

a barrel wheel;

a ratchet wheel;

a rotary weight;

a transmission wheel that causes the ratchet wheel to rotate;

a pawl lever, which engages with the transmission wheel, is interlocked with the rotary weight, and performs forward/backward movement in directions of approaching and moving away from the transmission wheel;

a base panel; and a wheel train bearing provided between the base panel and the rotary weight, wherein the pawl lever and the transmission wheel are positioned between the base panel and the wheel train bearing, wherein the transmission wheel is pivotally supported by the wheel train bearing, and wherein the wheel train bearing is provided with a release portion for releasing the pawl lever and the transmission wheel from engagement therebetween by moving the pawl lever.

2. The timepiece movement according to claim 1, wherein the release portion is a through-hole which penetrates through the wheel train bearing and into which an operation member that moves the pawl lever is inserted.

3. The timepiece movement according to claim 1, wherein the pawl lever has a pulling pawl lever portion and a pushing pawl lever portion which pinch the transmission wheel therebetween in plan view, wherein the pulling pawl lever portion has a pulling pawl that engages with the transmission wheel, wherein the pushing pawl lever portion has a pushing pawl that engages with the transmission wheel, wherein the release portion is a first through-hole and a second through-hole that penetrate through the wheel train bearing, and wherein, in a case where the pawl lever is positioned at a predetermined position in a movable range of the forward/backward movement, a part of an opening of the first through-hole on the base panel side overlap the pulling pawl lever portion and the rest of the opening is positioned on the pushing pawl lever portion side from the pulling pawl lever portion in plan view, and a part of an opening of the second through-hole on the base panel side overlap the pushing pawl lever portion and the rest of the opening is positioned on the pulling pawl lever portion side from the pushing pawl lever portion in plan view.

4. The timepiece movement according to claim 3, wherein the predetermined position is a position at which the pawl lever is closest to the transmission wheel.

5. The timepiece movement according to claim 3, wherein an opening of the first through-hole on the rotary weight side is larger than the opening of the first through-hole on the base panel side, and wherein an opening of the second through-hole on the rotary weight side is larger than the opening of the second through-hole on the base panel side.

6. The timepiece movement according to claim 2, wherein the rotary weight is provided in the wheel train bearing.

7. The timepiece movement according to claim 1, further comprising:

a winding stem; and a manual winding wheel train that is interlocked with rotation of the winding stem and causes the ratchet wheel to rotate.

8. A mechanical timepiece comprising:

the timepiece movement according to claim 1; and a case in which the timepiece movement is accommodated.

9. A mechanical timepiece comprising:

the timepiece movement according to claim 2; and a case in which the timepiece movement is accommodated.

10. A mechanical timepiece comprising:

the timepiece movement according to claim 3; and a case in which the timepiece movement is accommodated.

11. A mechanical timepiece comprising:

the timepiece movement according to claim 4; and a case in which the timepiece movement is accommodated.

12. A mechanical timepiece comprising:

the timepiece movement according to claim 5; and a case in which the timepiece movement is accommodated.

13. A mechanical timepiece comprising:

the timepiece movement according to claim 6; and a case in which the timepiece movement is accommodated.

14. A mechanical timepiece comprising:

the timepiece movement according to claim 7; and a case in which the timepiece movement is accommodated.

15. A method for releasing a pawl lever from engagement in a timepiece movement which includes: a barrel wheel; a ratchet wheel; a rotary weight; a transmission wheel that causes the ratchet wheel to rotate; a pawl lever that engages with the transmission wheel, is interlocked with the rotary weight, and performs forward/backward movement in directions of approaching and moving away from the transmission wheel; a base panel; and a wheel train bearing provided between the base panel and the rotary weight, in which the pawl lever and the transmission wheel are positioned between the base panel and the wheel train bearing, the transmission wheel is pivotally supported by the wheel train bearing, and the wheel train bearing is provided with a through-hole, the method comprising:

inserting an operation member into the through-hole from the rotary weight side, pushing and moving the pawl lever by the operation member, and releasing the pawl lever and the transmission wheel from engagement therebetween.

* * * * *